United States Patent [19]

Burgmans et al.

[11] Patent Number: 4,871,942

[45] Date of Patent: Oct. 3, 1989

[54] LOW-PRESSURE DISCHARGE LAMP

[75] Inventors: Adrianus L. J. Burgmans; Petrus R. Van Ijzendoorn, both of Eindhoven, Netherlands

[73] Assignee: U.S. Philips Corporation, New York, N.Y.

[21] Appl. No.: 849,350

[22] Filed: Apr. 7, 1986

Related U.S. Application Data

[63] Continuation of Ser. No. 732,798, May 9, 1985, abandoned, which is a continuation of Ser. No. 512,316, Jul. 8, 1983, abandoned, which is a continuation of Ser. No. 237,301, Feb. 23, 1981, abandoned.

[30] Foreign Application Priority Data

Mar. 4, 1980 [NL] Netherlands ..... 8001280

[51] Int. Cl.[4] ..... H01J 61/10

[52] U.S. Cl. ..... 313/493; 313/610

[58] Field of Search ..... 313/609, 610, 493

[56] References Cited

U.S. PATENT DOCUMENTS

| | | | |
|---|---|---|---|
| 3,551,736 | 12/1970 | Doehner | 313/204 X |
| 3,609,436 | 9/1971 | Campbell | 313/610 X |
| 3,849,689 | 11/1974 | Campbell | 313/493 |
| 4,260,931 | 4/1981 | Wesselink et al. | 313/204 X |
| 4,281,271 | 7/1981 | Young et al. | 313/204 X |

*Primary Examiner*—Kenneth Wieder

*Attorney, Agent, or Firm*—David R. Treacy

[57] ABSTRACT

The invention relates to a low-pressure discharge lamp having a discharge space which is limited by at least two walls (1, 2) which are at some distance from each other, there being present in this discharge space a third, thin-walled member (7) which alternately extends to at least near one wall (1) and the other wall (2), the discharge path being folded. The thin-walled member (7) has end faces, (14), which extend in parallel with the walls 1 and 2 and which are connected thereto in a discharge-tight manner.

17 Claims, 3 Drawing Sheets

LOW-PRESSURE DISCHARGE LAMP

This is a continuation of application Ser. No. 732,798, filed May 9, 1985, which was a continuation of Ser. No. 512,316, filed July 8, 1983, now abandoned, which was a continuation of Ser. No. 237,301, filed Feb. 23, 1981, now abandoned.

BACKGROUND OF THE INVENTION

The invention relates to a low-pressure discharge lamp, having a discharge space which is closed in a vacuum-tight manner and which contains a metal vapor and a rare gas, and electrodes between which a discharge takes place during operation of the lamp; and more particularly to such a lamp, in which this discharge space is limited by two walls which are spaced apart, and a thin-walled member is arranged in the discharge space and has such a shape and dimensions that, in conjunction with the two walls, it defines a folded path for the discharge. Such a lamp is disclosed in Austrian Patent Specification 244,451.

The lamp described in the above-mentioned Patent Specification has relatively small dimensions, while the discharge path is relatively long. Constructed as, for example, a low pressure mercury vapor discharge lamp and provided with a suitable lamp base, such a lamp is suitable for use in luminaires for incandescent lamps for general illumination purposes.

In the lamp according to AT-PS 244,451 the walls which are spaced apart and enclose the discharge space are in the form of two co-axial conical glass envelopes, whose ends are sealed in a vacuum-tight manner by means of sealing glass. The thin-walled member located in the discharge space between the walls is of such a shape that during operation of the lamp a helical discharge path is created between the thin-walled body and the other walls. Discharge-tight connections are present between those walls and the member in the regions where the thin-walled member is located in the immediate vicinity of the walls. This prevents the discharge from emerging from the compartment formed by the member and one of the walls.

If a discharge were to emerge from a compartment and flash over to a neighbouring compartment, part of the discharge path would be short-circuited. The luminous flux and brightness distribution of the lamp would then be adversely affected.

In the known lamp the discharge-tight connections between the thin-walled member (which in accordance with this patent specification may consist of easily deformable material such as tin, coated with a thin glass layer) and the other walls are realised by applying, at least in the regions where the thin-walled member is located near or against the walls, a quantity of a luminescent material or a chemical material which is resistant to the action of the discharge. This requires an accurate positioning of the thin-walled member with respect to the two walls during manufacture of the lamp. Because of the specific shape of the thin-walled member, the discharge-tight connection in the known lamp extends over a relatively small area of contact between the walls and the thin-walled member. There is a risk that in the region of the connection the luminescent or chemical material detaches from the wall, for example owing to vibrations or shocks etc., so that flash-over of the discharge does in fact occur. A further disadvantage of the known lamp is that during operation dark stripes are visible on the lamp walls in the regions where the discharge-tight connections are provided between the thin-walled member and the glass wall. This is caused by the fact that the luminescent or chemical material present there hardly contributes to the production of light.

SUMMARY OF THE INVENTION

It is an object of the invention to provide a low-pressure discharge lamp of the type described in the opening paragraph, which can easily be produced and which does not have the above-mentioned disadvantages.

According to the invention, such a lamp is characterized in that portions of the thin-walled member are located against or near corresponding portions of the walls and extend parallel to the respective walls, at least those portions of the thin-walled member being permeable to light.

In a lamp according to the invention discharge-tight connections or barriers are formed between the walls and the thin-walled member end faces abutting there against or located at a short distance of those walls. This does not require special measures such as the provision of special connecting materials, as, for example, glass, chemical substances and such like. A lamp according to the invention has a uniform brightness and can be produced in a simple manner. The thin-walled member can, for example, be pushed between the walls, whereafter the rims at the ends of the walls and the thin-walled body can be connected to one another in a gas-tight manner by means of sealing glass.

A gap is preferably present between each of those thin-walled member portions and the adjacent portions of the walls opposite thereto, this gap forming a barrier to the discharge between two adjacent compartments, which are separated from one another by the gap. Short-circuiting of the discharge can then only occur if the gap is too thick and/or its length too short. The gap length is here defined as the distance measured along a thin-walled member portion in a direction perpendicular to the discharge path. The gap thickness is the distance between that portion and its adjacent wall in a direction perpendicular to the said portion. It was found that in a practical embodiment of a lamp according to the invention no short-circuiting of the discharge occurred at a gap length-to-gap thickness width ratio of approximately 10 or more. The electric field (the barrier) in the gap then has a value which is too high for short-circuiting in operating conditions which are normal for low-pressure discharge lamps. The discharge then travels along a path prescribed by the shape of the compartments. This embodiment has the advantage that during manufacture the so-called "pumping" of the lamp, which is then almost finished, proceeds relatively smoothly. "Pumping" is here defined as degassing the walls and the other lamp components, annealing and degassing of the electrodes, filling the lamp with the desired lamp atmosphere etc. Such a lamp, particular d.c. operated, has the advantage that mercury depletion near the anode, which occurs during operation of the lamp as the result of migration of mercury ions towards the cathode (cataphoresis), is counteracted by the diffusion of mercury atoms through the gaps into the region surrounding the anode. Finally, the embodiment has the advantage for low-pressure mercury vapor discharge lamps according to the invention that during fabrication of the lamp the luminescent layers applied to the walls and/or the thin-walled member are not damaged when the thin-walled member is inserted between the walls.

In one embodiment of a lamp according to the invention the walls, which are spaced apart, extend parallel to one another and are formed as two coaxial hollow glass cylinders. The cylinders are closed at one end (for example in the shape of a dome) and the other ends are connected in a gas-tight manner to one another at their edges.

Such a lamp can be produced in large quantities in a relatively simple manner. In a further embodiment of the lamp at least one of the walls (for example the inner wall) is substantially rectangular in a plane transverse to its axis. The discharge-tight connection between that wall and the thin-walled member is then particularly reliable. This embodiment has approximately the shape of an incandescent lamp for general lighting purposes. When constructed as a low-pressure mercury vapor discharge lamp, the luminescent material having been provided on, for example, the inside of the outer wall, it is possible to obtain with this lamp, by a suitable choice of that luminescent material, such color temperature that its use in living rooms is attractive. It is alternatively possible to construct the lamp as a relatively small low-pressure sodium vapor discharge lamp, for example for use as a light source for safety light. In an embodiment of the lamp four electrodes are present with two folded, separate paths for the discharge. Said lamp can be operated with a so-called "duo-circuit" well known in the art.

In a different embodiment of a lamp according to the invention the walls extend parallel to one another and are in the form of circular or rectangular plates between which the thin-walled member is located. The edges of the three components of the lamp are sealed together by means of sealing glass so that the discharge space (formed by said walls) is closed in a vacuum-tight manner. This results in flat lamps whose discharge path is folded a number of times. Such a lamp is suitable for use as, for example, a panel lamp. Such a lamp can also be integrated together with a starter, a ballast and a suitable lamp base to form a unit which is suitable for use in luminaires for incandescent lamps.

In a low-pressre mercury vapor discharge lamp according to the invention a luminescent layer is preferably applied to those sides of the parallel walls which face the discharge space. The thin-walled member is then free from luminescent material and consists of glass which is permeable to the untraviolet radiation generated in the mercury discharge.

In another embodiment of a low-pressure mercury vapor discharge lamp according to the invention, the luminescent material is only present on those portions of the walls and the thin-walled member which face the discharge path. The sides of the above-mentioned portions of the thin-walled member and the adjacent surfaces of the two walls are then free from luminescent material. Such lamps have a very uniform brightness as no shadow stripes are visible. Shadow stripes may be produced when visible light (generated in a first luminescent layer) passes locally a number of consecutive luminescent layers.

In a further embodiment of a low-pressure discharge lamp according to the invention one of the walls is coated with reflecting material. The light is then reflected towards a viewer. In a low-pressure mercury vapor discharge lamp according to the invention, the reflecting material may be provided on one of the walls, for example between the luminescent layer and the wall. Alternatively, it is possible to construct one of the walls itself as the reflecting body.

The invention will now be further explained with reference to the accompanying drawings, which show a number of embodiments of a lamp according to the invention.

DESCRIPTION OF THE PREFERRED EMBODIMENTS

Figure 1:
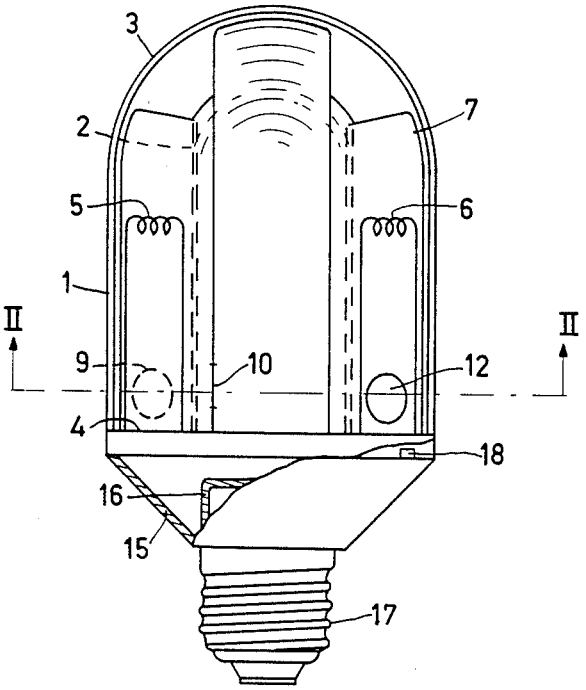
FIG. 1 shows a low-pressure mercury vapor discharge lamp according to the invention, partly in elevational view, partly in a longitudinal cross-sectional view.
Figure 2:
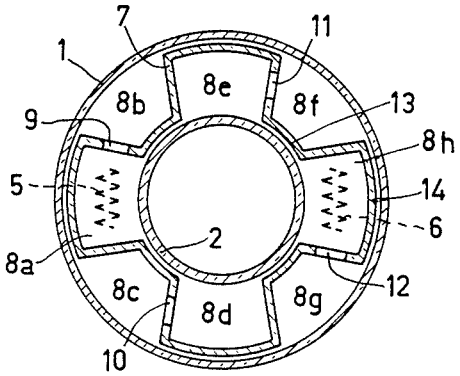
FIG. 2 shows a cross-sectional view through a lamp of FIG. 1, on the plane II—II.

The low-pressure mercury vapor discharge lamp shown in FIGS. 1 and 2 has a discharge space which is closed in vacuum-tight manner and is limited by two generally cylindrical glass walls 1 and 2, which are located at some distance from one another. (Wall 2 is shown in FIG. 1 by means of broken lines). These cylinders are domed at one end (3) and are sealed to each other in a vacuum-tight manner near their other ends 4 by means of sealing glass. The discharge space (formed by said cylindrical walls) comprises two electrodes 5 and 6 between which a discharge takes place during operation of the lamp. The discharge space is filled with mercury vapor and a rare gas. The discharge space comprises further a thin-walled glass member 7, which is placed between walls 1 and 2 and which is of such a shape and dimensions that it alternately extends to near the glass wall 1 and the glass wall 2, thereby dividing the discharge space in a number of compartments **8*a* to 8*h*, inclusive (see FIG. 2), the discharge passing through these compartments, one after the other, during operation. The discharge path is then partly curved for example in those places where it passes from one compartment to another through an apertures (for example 12) in the wall of member 7**.

The discharge passes from electrode 5 (which is located at the top (see FIG. 1) of compartment **8*a*) down through compartment 8*a*, through an aperture 9 to compartment 8*b*, from there upwards and down again along the side of the domed top 3, where compartment 8*b* changes into 8*c*, and then through aperture 10 to 8*d*. Through 8*d* the discharge passes up along the dome-shaped top to the back of the lamp, where 8*d* changes into 8*e*. At the bottom of the lamp the discharge passes via aperture 11 through 8*f* and follows a U-shaped path to the front of the lamp. The discharge then moves down via 8*g*, passes through aperture 12 and the upwards via 8*h* to end at electrode 6**.

The said apertures 9 to 12, inclusive, are positioned at some distance from the end 4. As a result thereof there are relatively cool spots in the discharge space, as the discharge is not present there. The conversion efficiency of applied electric energy into ultra-violet radiation of the relatively compact lamp is then high, in spite of the relatively high temperature in the discharge space during operation.

Figure 3:
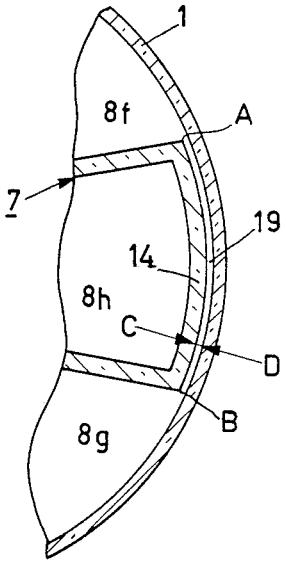
FIG. 3 is a detail of a cross-sectional view as shown in FIG. 2.

The portions of the thin-walled glass member 7 which are located near the glass walls 1 and 2 have end faces (for example 13 and 14), which extend parallel to wall 2 and wall 1, respectively (see also FIG. 3). The glass cylinders 1, 2 and 7 are produced by pressing by means of a suitable mould.

The lamp shown in FIG. 1 further comprises a lamp base 15, which incorporates a starter (not shown) and an electric stabilization ballast 16. The lamp base has a screwthread 17, so that the lamp can be screwed in a simple manner into incandescent lamp luminaire. The lamp base 15 is detachable, for example by means of a snap mechanism 18, from the remaining portion of the lamp comprising items 1 to 14.

FIG. 3 shows a detail of the cross-sectional view shown in FIG. 2. A narrow gap 19 is present between end face 14 of the thin-walled member 7 and the adjacent wall portion, located opposite face 14, of glass wall 1. The gap has a length AB and a thickness CD. If the ratio AB:CD is larger than approximately 10 and CD has a maximum of 2 mm, then short-circuiting of the discharge in compartments 8*f* and 8*g* through the gap 19 does not occur.

Figure 4:
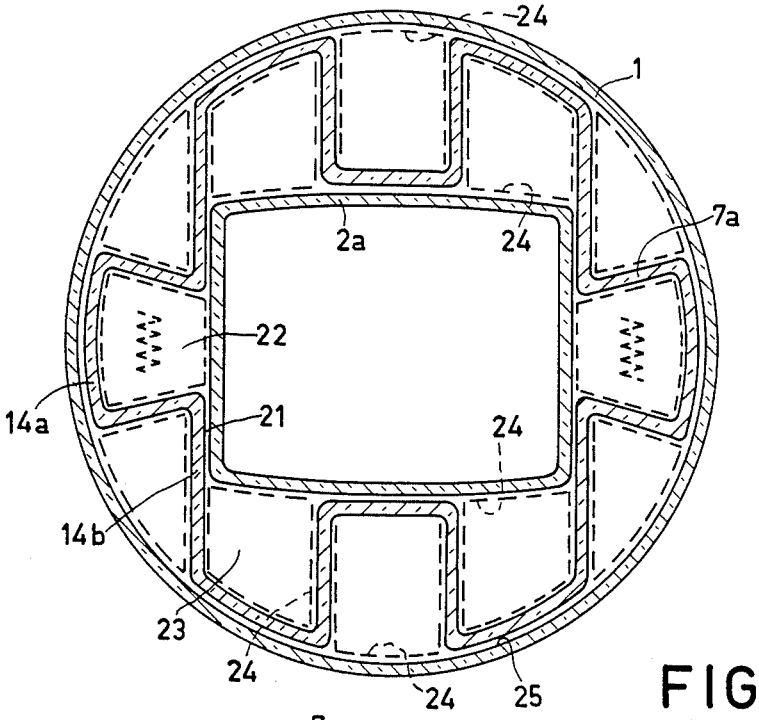
FIG. 4 is a cross-sectional view of a second embodiment of a lamp according to the invention.

FIG. 4 is a cross-sectional view through a cylindrical lamp according to the invention, in which the innermost glass cylinder 2 has a generally rectangular cross-section and the discharge space is divided into 12 serial compartments. The lamp is assembled from three glass member 1, 2*a* and 7*a*, which are closed at one end. Gaps having such a length and thickness that discharge-tight connections are formed (at 21 between compartments 22 and 23) are present between the end faces (14*a* and 14*b*) of member 7*a* and the respective walls of the cylindrical members 1 and 2. Only those portions of the members 1, 2*a* and 7*a* which face the discharge path have been coated with a luminescent layer 24 (shown in broken lines in the drawing). The remaining portions (for example portion 25 of the inner wall surface of cylinder 1) are free from luminescent material to prevent the light from passing through a number of consecutive luminescent layers, which would adversely affect the luminous flux.

Figure 5:
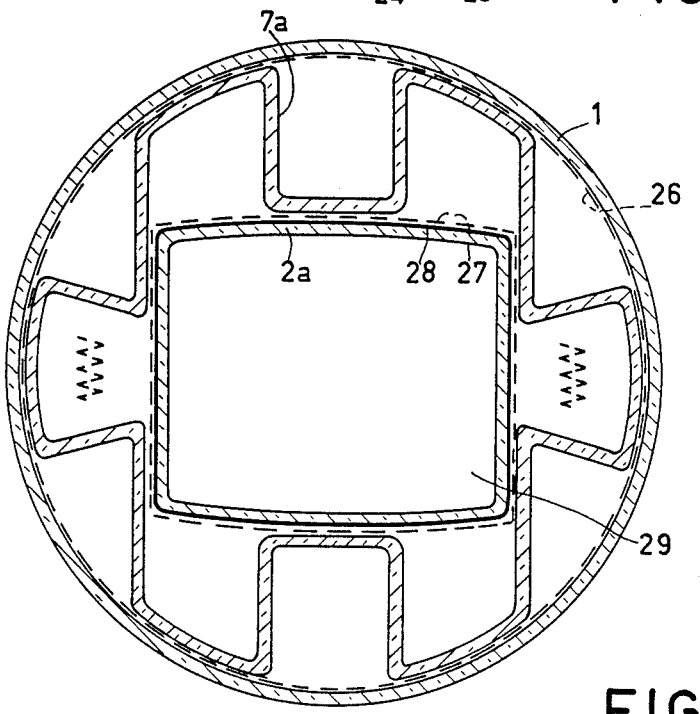
FIG. 5 is a cross-sectional view of a third embodiment.

The embodiment shown in FIG. 5 also shows a cross-sectional view through a low-pressure mercury vapor discharge lamp according to the invention, the glass cylinder 2*a* again having a rectangular cross-section. The surfaces of the cylinders 1 and 2*a* facing the discharge space are coated over their entire surface with respective layers 26 and 27 of luminescent material. The thin-walled member 7*a* which divides the discharge space in a number of serially-arranged compartments through which the discharge passes, is made of glass which is permeable both to light and to the ultraviolet radiation generated by the discharge. This member is not coated with luminescent material. A layer 28 consisting of a reflecting material such as titanium dioxide, is provided between layer 27 and the wall surface of cylinder 2*a*. The drawing shows layer 28 as a solid line. This layer reflects the light towards the outer wall 1. Instead of providing a reflecting layer it is alternatively possible to make the walls themselves of a reflecting material or to position a reflector in the hollow space inside cylinder 2. This hollow space (29) also has room for an electric stabilization ballast and/or a starter (not shown).

Figure 6:
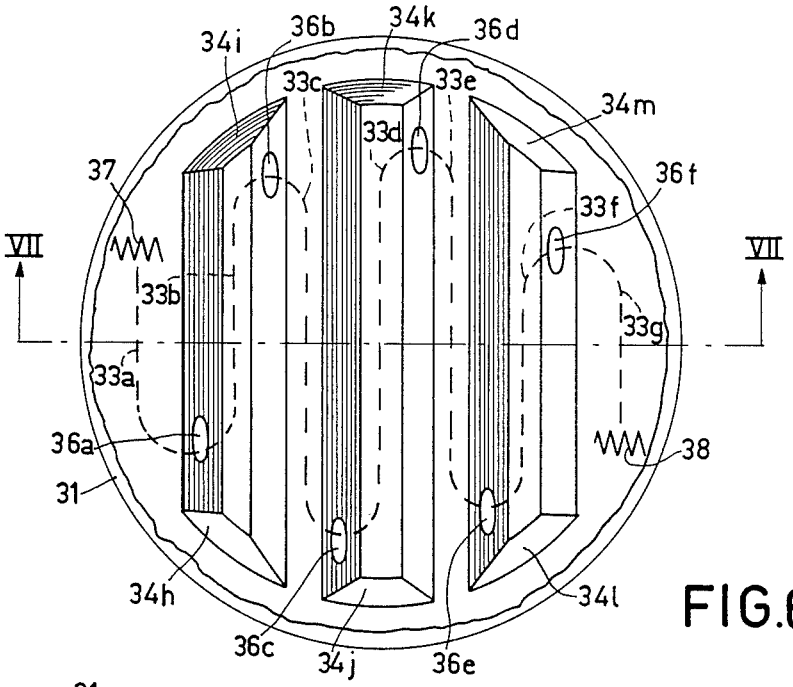
FIG. 6 is an embodiment of a flat lamp according to the invention in elevational view.

FIG. 6 is a plan view of a so-called flat low-pressure mercury vapor discharge lamp according to the invention. The discharge space of this lamp is limited by two circular parallel glass walls 31 and 32 (see also FIG. 7). A thin-walled glass member 33 of a zig-zag cross-section and which divides the discharge space into a number of communicating compartments 33*a* to 33*g*, inclusive, extends between the walls 31 and 32. Walls 31 and 32 and member 33 are sealed together at their edges by means of glass enamel. Wall 32 has a raised edge which simplifies the relative positioning of member 33 during manufacture and also the sealing of the edges to each other with glass enamel. The end faces 34*a* to 34*g*, inclusive (see FIG. 7) and 34*b* to 34*m* inclusive, respectively, of the member 33 extend parallel to the adjacent portions of walls 31 and 32. Small gaps are provided between the end faces and the respective adjacent portions. The dimensions of these gaps are such that, as described with reference to FIG. 3, short-circuiting of the discharge between adjacent compartments via the gaps cannot occur. Compartments 33*a* to 33*g* communicate with one another serially via a number of apertures 36*a* to 36*f*, inclusive. From electrode 37 the discharge moves down through compartments 33*a* and up again via aperture 36*a* through compartment 33*b*, and so on, to arrive finally at electrode 38. This causes the discharge (shown by a broken line) path to be folded. The apertures 36*a* to 36*f* inclusive, are located at a distance from the end of each compartment in order to create a cool spot in the discharge space.

Only those wall portions of the glass walls 31 and 32 and of the thin-walled member 33 which face the discharge path are coated with a luminescent layer in a manner comparable with the lamp shown in FIG. 4.

Figure 7:
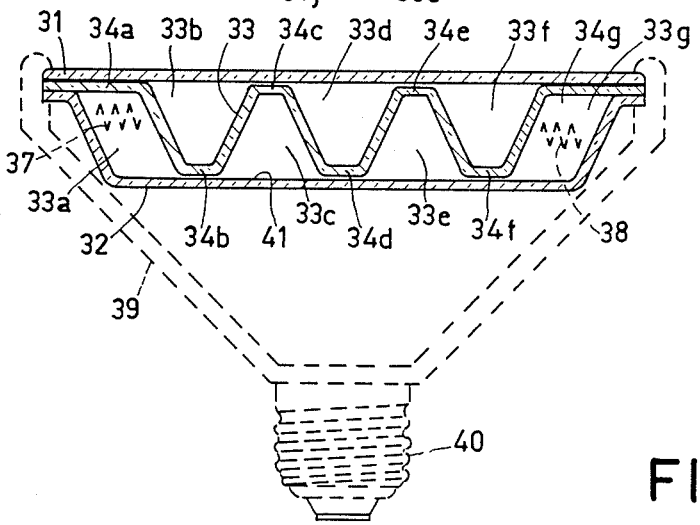
FIG. 7 is a cross-sectional view of a lamp of FIG. 6 on the plane VII—VII and FIG. 8 shows schematically a cross-sectional view of a lamp as shown in FIG. 6, a filamentary thinly distributed member being present in the discharge space.

The lamp shown in FIG. 6 may be constructed as a circular lamp as shown or as a rectangular lamp, that is to say that the contours of the plates 31, 32 and 33 may be of the shown circular shape but may, alternatively, be rectangular. An embodiment is alternatively conceivable in which a lamp having an integral starter and ballast is obtained by means of an envelope connected to the lamp. Such a lamp can be screwed into incandescent lamp fittings by means of a suitable lamp cap. FIG. 7 shows schematically by means of broken lines in addition to the cross-sectional view of the lamp of FIG. 6, an envelope 39 and a lamp cap 40 on the plane VII—VII. In such an embodiment wall 32 may be coated with a reflecting layer on surface 41.

Figure 8:
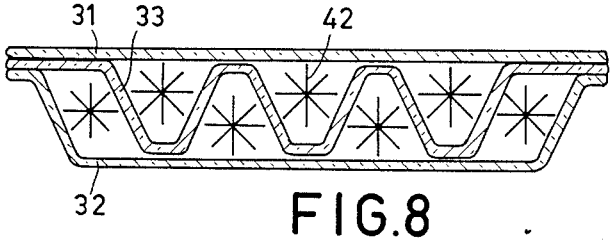

FIG. 8 also shows a cross-sectional view of a lamp as shown in FIG. 6, in which there is present in the discharge space between the glass walls 31 and 32 a filamentary body 42 which is thinly distributed through that discharge space. Such a body may consist, for example, of thinly distributed glass wool (see U.S. Pat. No. 4,163,169) or of a brush-shaped body (see U.S. Pat. No. 4,143,447). The body 42 shown schematically in FIG. 8, is used to increase the radiant efficiency per unit of lamp volume. The dimensions of such a lamp comprising a thinly-distributed body can be reduced while maintaining the same efficiency.

In a practical embodiment of a low-pressure mercury vapor discharge lamp as shown in FIG. 1 the inside diameter of the outer cylinder 1 was approximately 55 mm. Its height was approximately 60 mm (exclusive of the lamp base). The length thickness ratio of the gaps near the end faces was approximately 15. With an overall length of the discharge path of approximately 40 cm and a gas fill of mercury and argon (400 Pa), the lamp had an efficiency of approximately 60 lm/W at an applied power to the lamp of 15W. The wall portions facing the discharge had a luminescent layer consisting of a mixture of two phosphors, namely green luminescent, terbium-activated cerium magnesium aluminate and red luminescing, trivalent-europium activated yttrium oxide. A reflecting layer consisting of titanium dioxide was present on the wall of the inner cylinder between the luminescent layer and the wall.

In a practical embodiment of a low-pressure mercury vapor discharge lamp as shown in FIG. 6 the lamp efficiency, with the same phosphors as in the above-described embodiment, was approximately 70 lm/W at an applied power to the lamp of 15W. The overall length of the discharge path was approximately 40 cm. The diameter of the circular plates was approximately 10 cm. The discharge between the plates was approximately 1 cm.

What is claimed is:

1. A low-pressure discharge lamp comprising:

an outer first wall which is permeable to light, an inner second wall spaced from said outer first wall, said first and second walls defining and enclosing a discharge space therebetween, an ionizable material contained in said discharge space, spaced electrodes disposed in said discharge space, between which electrodes a discharge takes place during normal operation of the lamp, and a thin-walled member disposed between said walls and comprising first portions, second portions, and dividing portions, for dividing said discharge space into a plurality of compartments which are interconnected so as to define an elongated discharge path between said electrodes;

said first portions being permeable to light and being disposed proximate to respective corresponding portions of said first wall to define respective first barriers, and said second portions being disposed proximate to respective corresponding portions of said second wall to define respective second barriers;

each said dividing portion extending between a respective one of said first portions and a respective one of said second portions to separate adjoining compartments through which said discharge path extends, an inner adjoining compartment being defined by a respective first portion, two of said dividers and part of said second wall, and an adjoining outer compartment being defined by one of said two of said dividers, the respective second portion, another divider and part of said first wall whereby during normal operation said discharge takes place on both sides of respective dividing portions, on the inner side of said first portions, and the outer side of said second portions;

the first barriers being arranged so as to prevent short-circuiting between the adjacent outer compartments, and the second barriers being arranged so as to prevent short-circuiting between the adjacent inner compartments.

2. A lamp as claimed in claim 1, characterized in that said dividing portions are permeable to light; and in that said thin-walled member is arranged such that said respective corresponding portions of said first wall, portions of said first wall bounding the compartments defined in part by respective ones of said second portions of said thin-walled member, and portions of said first major wall adjoining said dividing portions together constitute substantially all of said first major wall, whereby said first major wall has substantially uniform brightness.

3. A low-pressure discharge lamp comprising:

an outer first wall which is permeable to light, an inner second wall spaced from said outer first wall, said first and second walls defining and enclosing a discharge space therebetween, an ionizable material contained in said discharge space, spaced electrodes disposed in said discharge space, between which electrodes a discharge takes place during normal operation of the lamp, and a thin-walled member formed entirely of a light permeable material disposed between said walls and comprising first portions, second portions, and dividing portions, for dividing said discharge space into a plurality of compartments which are interconnected so as to define an elongated discharge path between said electrodes;

said first portions being disposed proximate to corresponding respective portions of said first wall to define respective first barriers, and said second portions being disposed proximate to respective corresponding portions of said second wall to define respective second barriers;

each said dividing portion extending between a respective one of said first portions and a respective one of said second portions to separate adjoining compartments through which said discharge path extends, an inner adjoining compartment being defined by a respective first portion, two of said dividers and part of said second wall, and an adjoining outer compartment being defined by one of said two of said dividers, the respective second portion, another divider and part of said first wall whereby during normal operation said discharge takes place on both sides of respective dividing portions, on the inner side of said first portions, and the outer side of said second portions;

the first barriers being arranged so as to prevent short-circuiting between the adjacent outer compartments, and the second barriers being arranged so as to prevent short-circuiting between the adjacent inner compartments.

4. A lamp as claimed in claim 3, characterized in that said thin-walled member is formed entirely of glass.

5. A low-pressure discharge lamp comprising:

an outer first wall which is permeable to light, an inner second wall spaced from said outer first wall, said first and second walls defining and enclosing a discharge space therebetween, an ionizable material contained in said discharge space, spaced electrodes disposed in said discharge space, between which electrodes a discharge takes place during normal operation of the lamp, and a thin-walled member formed entirely of a light permeable material disposed between said walls, separate from and not directly connected to either of said walls, and comprising first portions, second portions, and dividing portions, for dividing said discharge space into a plurality of compartments which are interconnected so as to define an elongated discharge path between said electrodes;

said first portions being spaced from and disposed parallel and proximate to respective corresponding portions of said first wall to define respective first barrier gaps and said second portions being spaced from and disposed parallel and proximate to respective corresponding portions of said second wall to define respective second barrier gaps;

each said dividing portion extending between a respective one of said first portions and a respective one of said second portions to separate adjoining compartments through which said discharge path extends, an inner adjoining compartment being defined by a respective first portion, two of said dividers and part of said second wall, and an adjoining outer compartment being defined by one of said two of said dividers, the respective second portion, another divider and part of said first wall whereby during normal operation said discharge takes place on both sides of respective dividing portions, on the inner side of said first portions, and the outer side of said second portions; and each gap having a length, between adjacent compartments bounded by a same wall, in proportion to thickness of the gap sufficient to prevent short-circuiting of the discharge through the gap during normal lamp operation.

6. A lamp as claimed in claim 5, characterized in that said length of each gap is at least approximately ten times the respective gap thickness.

7. A lamp as claimed in any one of claims 1–6, characterized in that said first and second walls are each substantially cylindrical and have first and second ends; and the lamp further comprises respective wall portions closing the first ends of the cylinders formed by said major walls, and means for interconnecting said second ends to one another in a gas-tight manner.

8. A lamp as claimed in claim 7, characterized in that at least said inner second wall has a tranverse section, perpendicular to the cylinder axis, which is substantially rectangular.

9. A lamp as claimed in claim 7, characterized in that said second wall is coated with a light-reflecting material.

10. A lamp as claimed in any one of claims 1–6, characterized in that said inner and outer walls each consist essentially of a substantially cylindrical part and a domed end part, defining respective cylinders each closed at a first end; and said thin-walled member has a domed end disposed between the domed ends of said first and second walls, arranged such that a plurality of said compartments extend through said domed end of the thin-walled member, whereby the first major wall has substantial uniform brightness over its cylindrical and domed end parts.

11. A lamp as claimed in any one of claims 1–6, characterized in that said first and second walls are parallel plates.

12. A lamp as claimed in claim 11, characterized in that said second wall is coated with a light-reflecting material.

13. A lamp as claimed in any one of claims 1–6, characterized in that the discharge path is configured such that at least one of said compartments includes a region having a relatively low temperature during normal operation of the lamp.

14. A lamp as claimed in any one of claims 1–6, comprising a filamentary body having a thinly distributed discharge-permeable structure disposed in said discharge space.

15. A lamp as claimed in any one of claims 1–6, comprising a luminescent layer coating the inner surface of said outer first wall and the outer surface of said inner second wall, facing said discharge space.

16. A lamp as claimed in any one of claims 1–6, comprising a luminescent layer coated on only those surfaces of said first and second walls and said thin-walled element which bound said compartments.

17. A low-pressure discharge lamp comprising:

an outer first wall which is permeable to light, an inner second wall spaced from said outer first wall, said first and second walls defining and enclosing a discharge space therebetween, an ionizable material contained in said discharge space, spaced electrodes disposed in said discharge space, between which electrodes a discharge takes place during normal operation of the lamp, and a thin-walled member disposed between said walls and comprising first portions, second portions, and dividing portions, for dividing said discharge space into a plurality of compartments which are interconnected so as to define an elongated discharge path between said electrodes;

said first portions being permeable to radiation emitted by said discharge during normal operation and being disposed proximate to respective corresponding portions to said first wall to define respective first barriers, and said second portions being disposed proximate to respective corresponding portions of said second wall to define respective second barriers;

each said dividing portion extending between a respective one of said first portions and a respective one of said second portions to separate adjoining compartments through which said discharge path extends, an inner adjoining compartment being defined by a respective first portion, two of said dividers and part of said second wall, and an adjoining outer compartment being defined by one of said two of said dividers, the respective second portion, another divider and part of said first wall whereby during normal operation said discharge takes place on both sides of respective dividing portions, on the inner side of said first portions, and the outer side of said second portions;

the first barriers being arranged so as to prevent short-circuiting between the adjacent outer compartments, and the second barriers being arranged so as to prevent short-circuiting between the adjacent inner compartments.

* * * * *